US006325084B1

(12) United States Patent
Cohen

(10) Patent No.: US 6,325,084 B1
(45) Date of Patent: Dec. 4, 2001

(54) COMBINED UMBRELLA AND FAN DEVICE

(75) Inventor: Ronald B. Cohen, Hopkinton, MA (US)

(73) Assignee: Kids Only, Inc., Framingham, MA (US)

( * ) Notice: Subject to any disclaimer, the term of this patent is extended or adjusted under 35 U.S.C. 154(b) by 0 days.

(21) Appl. No.: 09/550,183

(22) Filed: Apr. 14, 2000

(51) Int. Cl.[7] ..... A45B 23/00; F16M 13/00
(52) U.S. Cl. ..... 135/16; 417/313
(58) Field of Search ..... 135/16; 417/313

(56) References Cited

U.S. PATENT DOCUMENTS

| | | | |
|---|---|---|---|
| D. 409,369 | | 5/1999 | Vega . |
| 1,148,332 | | 7/1915 | Onyskow . |
| 3,177,881 | | 4/1965 | Covington . |
| 5,007,811 | | 4/1991 | Hopkins . |
| 5,172,711 | | 12/1992 | Mueller et al. . |
| 5,273,062 | | 12/1993 | Mozdzanowski . |
| 5,349,975 | | 9/1994 | Valdner . |
| 5,765,582 | | 6/1998 | Molnar, IV . |
| 5,887,771 | | 3/1999 | Perry . |
| 5,967,161 | | 10/1999 | Neal . |
| 6,017,188 | * | 2/2000 | Benton ..... 416/5 |
| 6,027,309 | * | 2/2000 | Rawls et al. ..... 416/5 |

* cited by examiner

*Primary Examiner*—Robert Canfield
(74) *Attorney, Agent, or Firm*—Iandiorio & Teska

(57) ABSTRACT

A combined umbrella and fan device wherein the umbrella includes a fabric or vinyl canopy, an umbrella hub, a plurality of splines hingedly attached to the umbrella hub supporting the fabric or vinyl canopy, an umbrella shaft extending from the umbrella hub, and a slide collar on the umbrella shaft including a plurality of support stays hingedly interconnected with the splines. The fan subassembly includes a fan motor housing, a clamp for attaching the motor housing to the umbrella shaft below the slide collar of the umbrella, a fan blade hub assembly rotatably disposed about the umbrella shaft between the slide collar and the clamp and having fan blades extending therefrom, a drive collar about the umbrella shaft and attached to and disposed beneath the fan blade hub assembly, a bushing on the shaft between the clamp and the drive collar for rotatably supporting the drive collar, and a drive wheel extending from the motor housing and engaging the drive collar for rotating the drive collar.

15 Claims, 4 Drawing Sheets

COMBINED UMBRELLA AND FAN DEVICE

FIELD OF THE INVENTION

This invention relates primarily to a battery operated fan for a children's play umbrella which can also be adapted to full size adult patio umbrellas and the like.

BACKGROUND OF THE INVENTION

Electric fans for patio umbrellas are known but are typically fairly complex, difficult to assemble, and AC powered.

For example, in U.S. Pat. No. 5,007,811 an electric motor turns a rotatable drive ring supported on the umbrella shaft by a number of bearings through a fairly complex gear train. In U.S. Pat. No. 5,765,582 an electric AC motor is connected by a belt to a pulley which in turn drives a gear in the base of the umbrella stand.

Other patents in this field include Nos. 5,172,711; 5,273,062; 5,349,975; 5,887,771; 5,967,161; 3,177,881; 1,148,332; and Des. 409,369, all incorporated herein by this reference. None of these fans are suitable for use by children nor are they particularly adapted for a child's play set which includes an umbrella, a play table, and a number of chairs.

SUMMARY OF THE INVENTION

It is therefore an object of this invention to provide a simpler and easier to assemble combined umbrella and fan device.

It is a further object of this invention to provide a much safer fan for an umbrella.

It is a further object of this invention to provide a fan which is more universal in design and which can be used with a number of different types of umbrellas.

This invention results from the realization that a much simpler, easier to assemble, more universal, and much safer fan for an umbrella incorporates a simple rotatable fan drive collar on the umbrella shaft and a motor drive wheel which frictionally engages the drive collar to rotate soft foam fan blades attached to the drive collar until there is any interference, such as a child's hand, whereupon, although the motor drive wheel continues to rotate, the fan drive collar doesn't thereby protecting the child's hand.

This invention features a combined umbrella and fan device including an umbrella with a fabric canopy, an umbrella hub, a plurality of splines hingedly attached to the umbrella hub supporting the fabric canopy, an umbrella shaft extending from the umbrella hub, and a slide collar on the umbrella shaft including a plurality of support stays hingedly interconnected with the splines. The fan device includes a fan motor housing, a clamp for attaching the motor housing to the umbrella shaft below the slide collar of the umbrella, a fan blade hub assembly rotatably disposed about the umbrella shaft between the slide collar and the clamp and having fan blades extending therefrom, a drive collar about the umbrella shaft and attached to and disposed beneath the fan blade hub assembly, a bushing on the shaft between the clamp and the drive collar for rotatably supporting the drive collar, and a drive wheel extending from the motor housing and engaging the drive collar for rotating the drive collar.

In the preferred embodiment, the fan blade hub assembly includes a plurality of fan blade shafts extending therefrom, each fan blade secured below each fan blade shaft. The fan blades are preferably made of a resilient material and there are a plurality of planar reinforcement strips, each adhered on the bottom thereof to the top of a fan blade and each adhered on the top thereof to a fan blade shaft.

There is typically a spacer element between the fan blade hub assembly and the drive collar and the drive collar may include a circumferential frictional rubber element thereon. The drive wheel then includes a rubber tire for frictionally engaging the rubber element.

In the preferred embodiment, each fan blade is disposed at an angle such that the leading edge thereof is angled upward towards the umbrella canopy and the trailing edge thereof includes a cutout for clearing the drive wheel.

This invention also features a fan device for an umbrella, the fan device comprising a fan motor housing a clamp for attaching the motor housing to an umbrella shaft a fan blade hub assembly rotatably disposed about the umbrella shaft and having fan blades extending therefrom a drive collar about the umbrella shaft and attached to and disposed beneath the fan blade hub a bushing between the clamp and the drive collar for rotatably supporting the drive collar and a drive wheel extending from the motor housing and engaging the drive collar for rotating the drive collar, the fan blade hub assembly, and the fan blades.

A fan device for an umbrella in accordance with this invention includes a fan motor housing having a drive wheel extending therefrom a clamp for attaching the motor housing to an umbrella shaft and a fan blade hub assembly rotatably disposed on the umbrella shaft, the fan blade hub assembly including a plurality of fan blades, and a drive surface frictionally engaged with said drive wheel so that if there is interference with the rotation of the fan blades, the fan blade hub assembly immediately stops rotating without endangering a person or damaging the fan motor.

BRIEF DESCRIPTION OF THE DRAWINGS

Other objects, features and advantages will occur to those skilled in the art from the following description of a preferred embodiment and the accompanying drawings, in which.

PREFERRED EMBODIMENT

Figure 1:
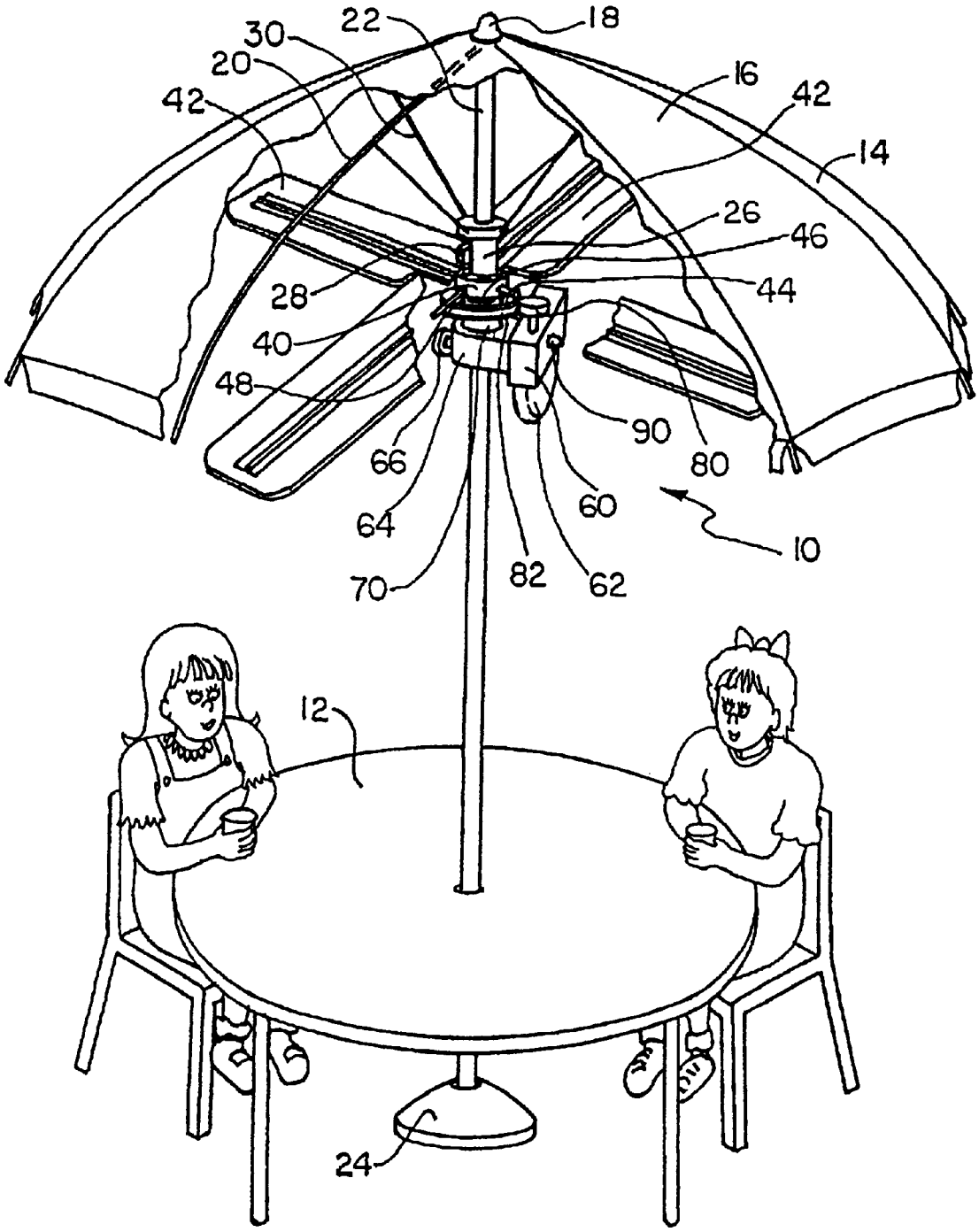
FIG. 1 is a schematic view of the combined umbrella and fan device of the subject invention.
Figure 5:
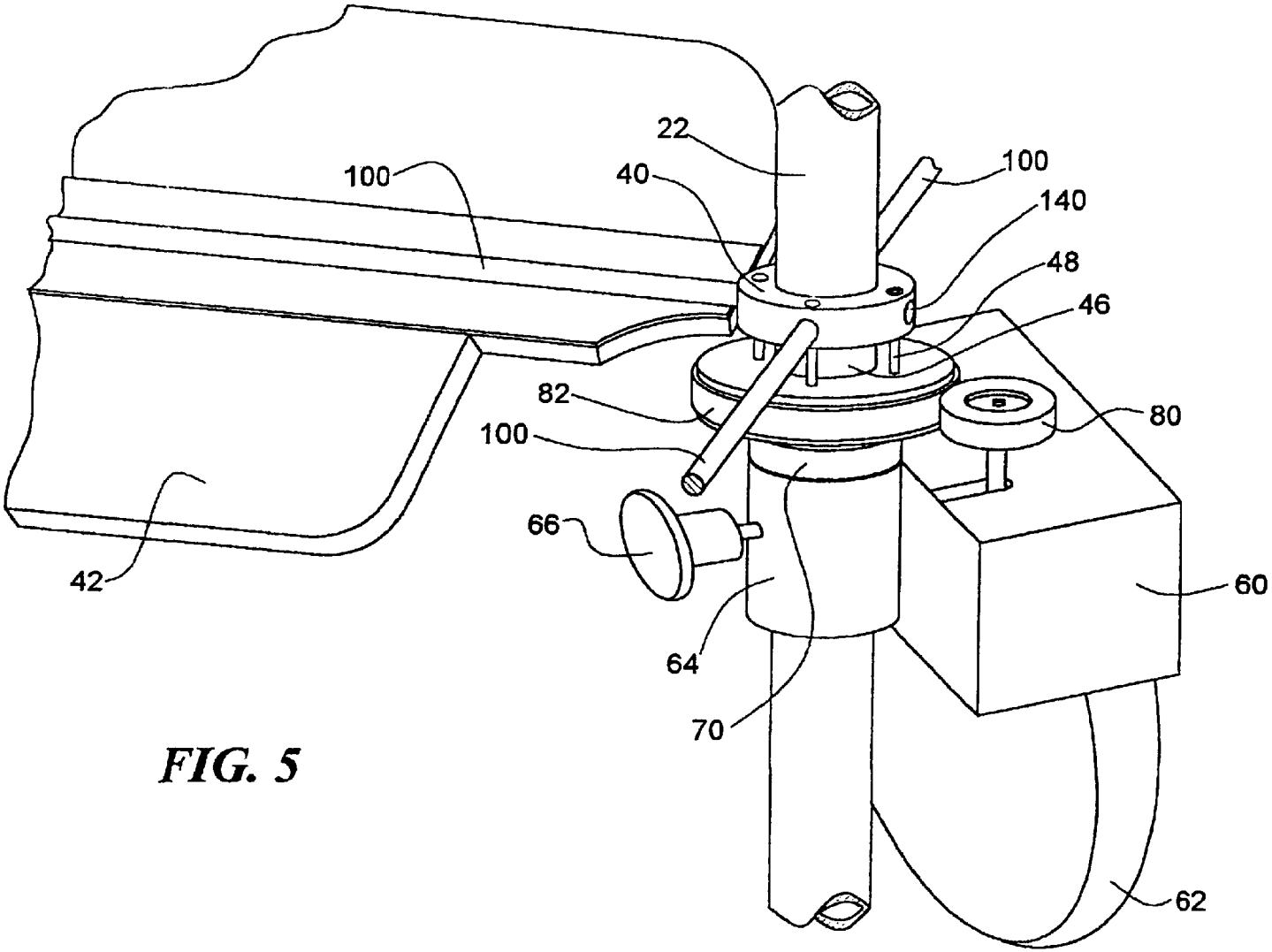
FIG. 5 is an assembly drawing of the primary components of the combined umbrella and fan device of the subject invention.

Combined umbrella and fan device 10, FIGS. 1 and 5 may be a part of a child's play set including play table 12 or may be incorporated with an adult size picnic or patio table.

In either case, device 10 includes umbrella 14 which may be a part of a toy set including table 12 or a child's or a homeowner's existing umbrella. Umbrella 14 includes a vinyl or fabric canopy 16 with some kind of a colorful pattern or fabric design associated therewith, umbrella hub 18, and a plurality of splines hingedly attached to umbrella hub 18 as shown at 20. The splines support fabric canopy 16 in the open position. Umbrella shaft 22 extends from hub 18 as shown and may terminate in base 24. Shaft 22 may be a one piece or a two piece design as is known in the art.

Slide collar 26 is disposed on shaft 22 and includes release button 28 for opening and closing umbrella canopy 16 as slide collar 26 is raised and lowered along shaft 22. A number of support stays 30 extend from slide collar 26 and each interconnects with a different spline by a simple hinge as is known in the art.

Figure 4:
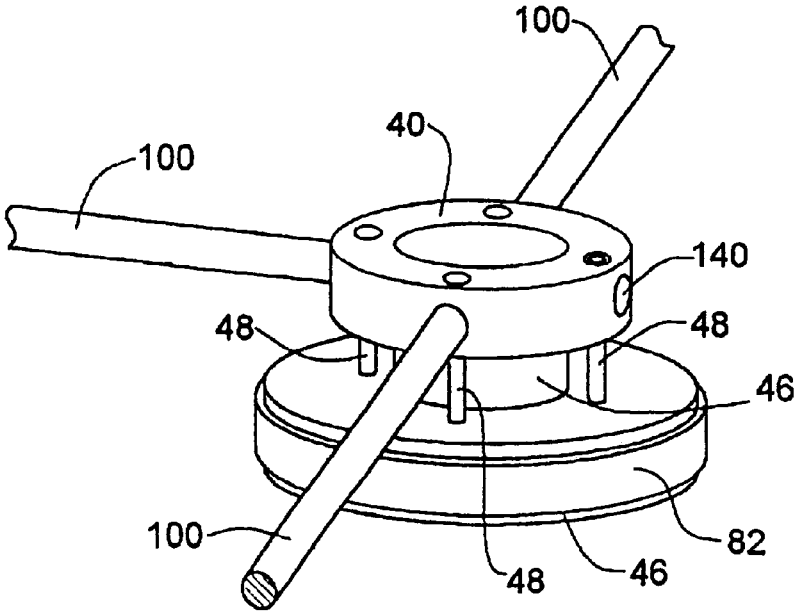
FIG. 4 is a schematic view of the drive collar and hub assembly of the subject invention.
Figure 3:
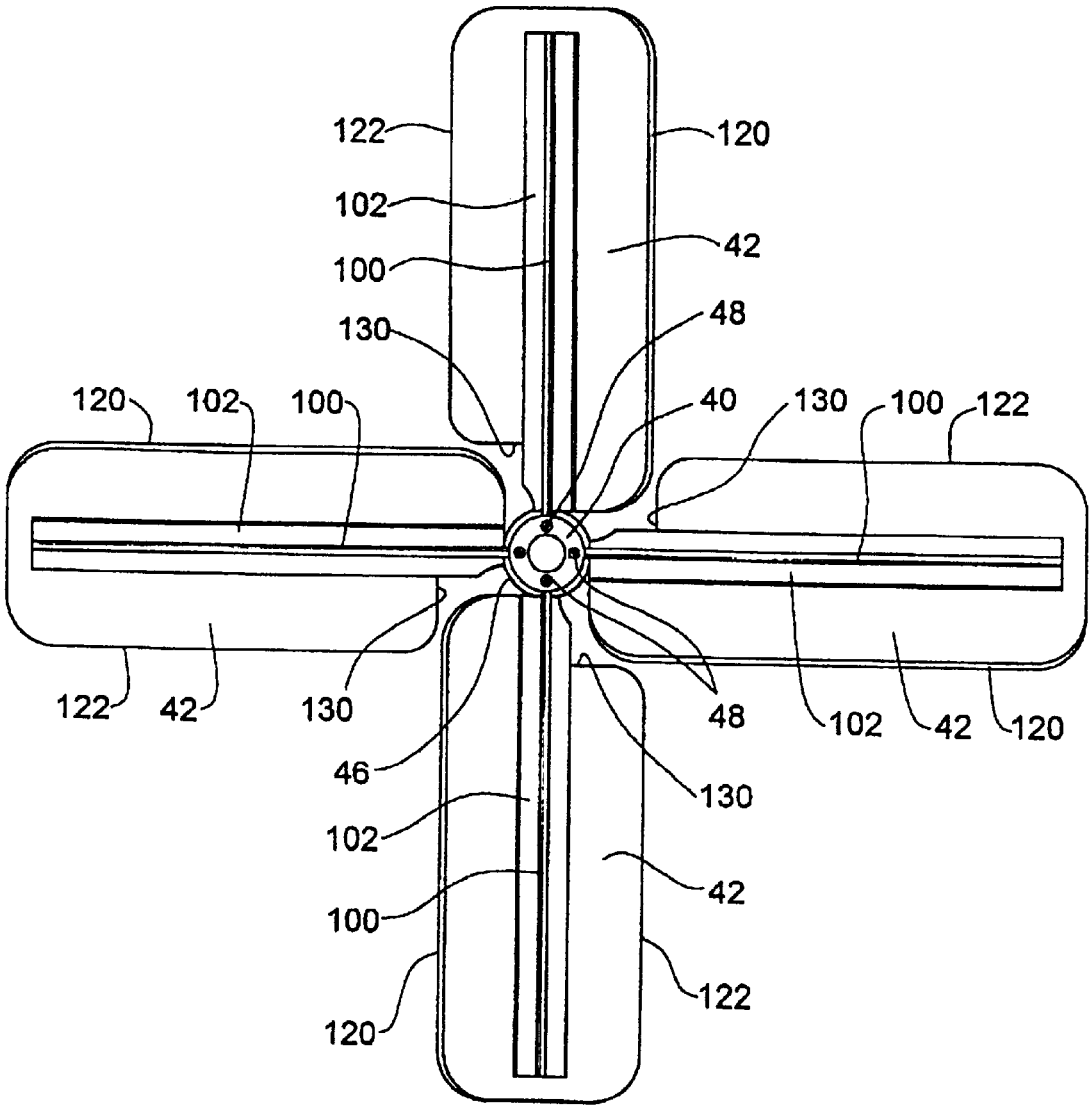
FIG. 3 is a top view of the fan blade hub assembly and the drive collar of the subject invention.

In this invention, fan blade hub assembly 40 FIGS. 1, 3, and 4 is rotatably disposed about umbrella shaft 22 beneath and spaced from slide collar 26. Fan blades 42 extend from fan blade hub assembly 40 as shown.

Drive collar 44 is spaced from hub assembly 40 by virtue of spacer element 46 but attached to hub assembly 40 via four screws 48. In the preferred embodiment, hub assembly 40, spacer element 46, and drive collar 44 are simple plastic washers disposed about shaft 22 to rotate as a unit about shaft 22 since screws 48 secure hub assembly 40 to drive collar 44 spaced therefrom by spacer element 46.

Figure 2:
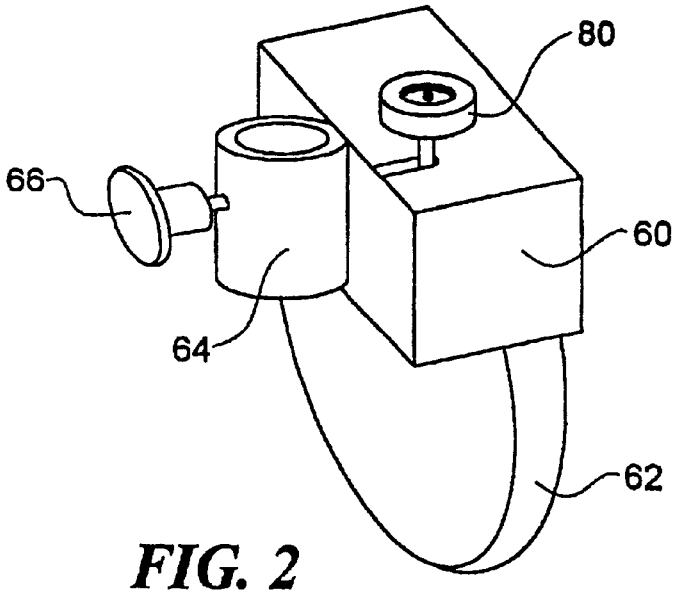
FIG. 2 is a schematic view of the fan motor housing and clamp assembly of the subject invention.

This complete unit is slid onto umbrella shaft 22 and can be removed quickly and easily for storage. Fan motor housing 60 with battery pack chamber 62, FIGS. 1 and 2, is removably locked in place on one side of umbrella shaft 22 beneath drive collar 44 by integral clamp 64 circumferentially engaging shaft 22. Screw lock 66 extends through the body of clamp 64 and releasably engages shaft 22 when tightened. Nylon or plastic bushing 70 on shaft 22 between clamp 64 and drive collar 44 supports drive collar 44 on shaft 22. Bushing 70 also provides the proper spacing between drive collar 44 and clamp 64, and reduces the friction associated with drive collar 44 as it rotates on shaft 22 by virtue of rubber tire drive wheel 80 extending from motor housing 60 which frictionally engages the periphery of drive collar 44. Drive collar 44 may include frictional rubber element 82 such as a wide rubber band.

Switch 90 is slid to the right to begin the operation of a battery powered motor in housing 60. The motor then turns rubber drive wheel 80 which is engaged with the periphery of drive collar 44. Then, by virtue of the frictional force between drive wheel 80 and drive collar 44, drive collar 44 begins to rotate and, since it is attached to hub assembly 40, hub assembly 40 also rotates on shaft 22 causing the rotation of fan blades 42.

Thus, the present design is fairly simple when compared to the prior art designs and much easier to assemble, operate, and disassemble. Moreover, the fan assembly can be removed from one umbrella and placed on another umbrella since and thus the fan assembly constitutes a more universal design than many of the fan blade assemblies of in the prior art.

Fan motor housing 60, fan blade hub assembly 40, and drive collar 44 are inexpensive and simple in design, simple to assemble, even by children, as compared to the rather complex gear (U.S. Pat. No. 5,007,811) or belt (U.S. Pat. No. 5,172,711) driven fan blade assemblies of the prior art. This invention is also safe for children—when a child's hand interferes with fan blades 42, drive collar 44 stops spinning. To that end, each fan blade is made of a very resilient material such as foam. In the preferred embodiment, as shown in FIG. 3, round plastic shafts 100 extend from orifices in hub 40 and are glued on their bottoms to the tops of plastic reinforcement strips 102 which are glued on their bottoms to the tops of each fan blade 42.

Drive wheel 80, FIG. 1 in one embodiment a rubber tire toy vehicle wheel. Thus, many of the components of the subject invention do not need to be specially manufactured and the complete fan device can be easily and inexpensively mass produced.

In order for the fan blades to clear the drive wheel as they rotate and also to provide improved air flow, fan blades 42 have a leading edge 120 and a trailing edge 122 such that the leading edge 120 is angled upwards toward the umbrella canopy and the trailing edge 122 has a cutout 130 proximate hub 40 to provide clearance between the drive wheel and the fan blades. Therefore, once plastic shafts 100 are glued to plastic strips 102 and plastic strips 102 are glued to fan blades 42, the plastic shafts are rotated slightly before their proximal ends are glued into the corresponding orifices in hub 40 as shown at 140, FIG. 4.

Thus, combined umbrella and fan device 10, FIG. 1 is simple in design and easy to assemble. Device 10 is safe for use by children and more universal in design.

Rotatable fan drive collar 46 on umbrella shaft 22 and a motor drive wheel 80 frictionally engages drive collar 46 to rotate soft foam fan blades 42 attached to the drive collar 46 until there is any interference, such as a child's hand, whereupon although motor drive wheel 80 continues to rotate, the fan drive collar 46 stops thereby protecting the child's hand.

The combination of drive wheel 80, FIGS. 1 and 5, mating with a drive surface (the periphery of drive collar 46) ensures that if a child's hand interferes with the rotation of fan blades 42, the fan blade assembly (hub 40, spacer 46, and drive collar 46) immediately and safely stops rotating and even though drive wheel 80 continues to rotate, the motor in housing 60 is not damaged. After the child's hand is removed, fan blades 42 once again begin rotating.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to physical interconnection. Moreover, any embodiments disclosed in the subject application are not to be taken as the only possible embodiments.

Other embodiments will occur to those skilled in the art and are within the following claims:

What is claimed is:

1. A combined umbrella and fan device comprising:

an umbrella including:

a fabric canopy, an umbrella hub, a plurality of splines hingedly attached to the umbrella hub supporting the fabric canopy, an umbrella shaft extending from the umbrella hub, a slide collar on the umbrella shaft including a plurality of support stays hingedly interconnected with the splines;

a fan motor housing;

a clamp for attaching the motor housing to the umbrella shaft below the slide collar of the umbrella;

a fan blade hub assembly rotatably disposed about the umbrella shaft between the slide collar and the clamp and having fan blades extending therefrom;

a drive collar about the umbrella shaft and attached to and disposed beneath the fan blade hub assembly;

a bushing on the shaft between the clamp and the drive collar rotatably supporting the drive collar on the clamp; and a drive wheel extending from the motor housing and engaging the drive collar for rotating the drive collar.

2. The device of claim 1 in which the fan blade hub assembly includes a plurality of fan blade shafts extending therefrom, each fan blade secured below each fan blade shaft.

3. The device of claim 1 in which there is a spacer element between the fan blade hub assembly and the drive collar.

4. The device of claim 1 in which the drive collar includes a circumferential frictional rubber element thereon.

5. The device of claim 4 in which the drive wheel includes a rubber tire for frictionally engaging the rubber element.

6. A fan device comprising:

a fan motor housing;

a clamp on the motor housing;

a fan blade hub assembly having fan blades extending therefrom;

a drive collar attached to and disposed beneath the fan blade hub;

a bushing between the clamp and the drive collar rotatably supporting the drive collar on the clamp; and a drive wheel extending from the motor housing and engaging the drive collar for rotating the drive collar.

7. The device of claim 6 in which the fan blade hub assembly includes a plurality of fan blade shafts extending therefrom, each fan blade secured below each fan blade shaft.

8. The device of claim 6 in which there is a spacer element second between the fan blade hub assembly and the drive collar.

9. The device of claim 6 in which the drive collar includes a circumferential frictional rubber element.

10. The device of claim 9 in which the drive wheel includes a rubber tire for frictionally engaging the rubber element.

11. A fan device comprising:

a fan motor housing having a drive wheel extending therefrom;

a clamp extending from the motor housing; and a fan blade hub assembly rotatably supported on the clamp and including a plurality of fan blades, and a drive surface frictionally engaged with said drive wheel so that if there is interference with the rotation of the fan blades, the fan blade hub assembly immediately stops rotating without endangering a person or damaging the fan motor.

12. A combined umbrella and fan device comprising:

an umbrella including:

a fabric canopy, an umbrella hub, a plurality of splines hingedly attached to the umbrella hub supporting the fabric canopy, an umbrella shaft extending from the umbrella hub, a slide collar on the umbrella shaft including a plurality of support stays hingedly interconnected with the splines;

a fan motor housing;

a clamp for attaching the motor housing to the umbrella shaft below the slide collar of the umbrella;

a fan blade hub assembly rotatably disposed about the umbrella shaft between the slide collar and the clamp and having fan blades made of resilient material extending therefrom;

a drive collar about the umbrella shaft and attached to and disposed beneath the fan blade hub assembly;

a bushing on the shaft between the clamp and the drive collar for rotatably supporting the drive collar;

a drive wheel extending from the motor housing and engaging the drive collar for rotating the drive collar;

a plurality of fan blade shafts extending from the fan blade hub assembly, each fan blade secured below each fan blade shaft; and a plurality of planar reinforcement strips, each adhered on the bottom thereof to the top of a fan blade and each adhered on the top thereof to a fan blade shaft.

13. A combined umbrella and fan device comprising:

an umbrella including:

a fabric canopy, an umbrella hub, a plurality of splines hingedly attached to the umbrella hub supporting the fabric canopy, an umbrella shaft extending from the umbrella hub, a slide collar on the umbrella shaft including a plurality of support stays hingedly interconnected with the splines;

a fan motor housing;

a clamp for attaching the motor housing to the umbrella shaft below the slide collar of the umbrella;

a fan blade hub assembly rotatably disposed about the umbrella shaft between the slide collar and the clamp and having fan blades extending therefrom;

a drive collar about the umbrella shaft and attached to and disposed beneath the fan blade hub assembly;

a bushing on the shaft between the clamp and the drive collar for rotatably supporting the drive collar; and a drive wheel extending from the motor housing and engaging the drive collar for rotating the drive collar, each fan blade disposed at an angle such that the leading edge thereof is angled upward towards the umbrella canopy and the trailing edge thereof includes a cutout for clearing the drive wheel.

14. A fan device comprising:

a fan motor housing;

a clamp on the motor housing;

a fan blade hub assembly including a plurality of fan blade shafts extending therefrom;

a fan blade secured below each fan blade shaft, the fan blades made of a resilient material;

a plurality of planar reinforcement strips, each adhered on the bottom thereof to the top of the fan blade and each adhered on the top thereof to a fan blade shaft;

a drive collar attached to and disposed beneath the fan blade hub;

a bushing between the clamp and the drive collar for rotatably supporting the drive collar; and a drive wheel extending from the motor housing and engaging the drive collar for rotating the drive collar.

15. A fan device comprising:

a fan motor housing;

a clamp on the motor housing;

a fan blade hub assembly having fan blades extending therefrom, each fan blade disposed at an angle such that the leading edge thereof is angled upward and the trailing edge thereof includes a cutout;

a drive collar attached to and disposed beneath the fan blade hub;

a bushing between the clamp and the drive collar for rotatably supporting the drive collar; and a drive wheel extending from the motor housing and engaging the drive collar for rotating the drive collar.

* * * * *